US006480080B1

(12) United States Patent
Asada et al.

(10) Patent No.: US 6,480,080 B1
(45) Date of Patent: Nov. 12, 2002

(54) MOLDED CASE CIRCUIT BREAKER

(75) Inventors: Tadashi Asada, Kanagawa (JP); Naoshi Uchida, Saitama (JP); Kazunori Yonemitsu, Saitama (JP); Masaru Isozaki, Kanagawa (JP); Toshiyuki Onchi, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/151,291

(22) Filed: May 21, 2002

(30) Foreign Application Priority Data

May 28, 2001 (JP) ..... 2001-158054
Apr. 3, 2002 (JP) ..... 2002-100741

(51) Int. Cl.[7] ..... H01H 83/00; H01H 1/32

(52) U.S. Cl. ..... 335/6; 335/16; 335/195; 200/244

(58) Field of Search ..... 335/6, 15, 16, 335/147, 185, 189–195, 201–204; 200/244

(56) References Cited

U.S. PATENT DOCUMENTS 6,184,761 B1 * 2/2001 Doma et al. ..... 218/22

FOREIGN PATENT DOCUMENTS

| | | |
|---|---|---|
| JP | 6-52777 | 2/1994 |
| JP | 6-28964 | 2/1999 |
| JP | 1-166429 | 6/2001 |

* cited by examiner

*Primary Examiner*—Ramon M. Barrera
(74) *Attorney, Agent, or Firm*—Kanesaka & Takeuchi

(57) ABSTRACT

A molded case circuit breaker includes a switching mechanism and a current-interrupting section. The current-interrupting section is composed of an insulated case, fixed contact shoes arranged diagonally opposite to each other, a bridging rotary contact shoe, a contact shoe holder, and arc extinguishing devices. The fixed contact shoes are composed of linear contact shoe conductors to reduce a height of the section, and the fixed contact shoes are arranged vertically in parallel and opposite each other so that the fixed contact shoes and the rotary contact shoe form a Z-shaped conducting path.

9 Claims, 6 Drawing Sheets

MOLDED CASE CIRCUIT BREAKER

BACKGROUND OF THE INVENTION AND RELATED ART STATEMENT

The present invention relates to a molded case circuit breaker, and in particular, to an assembly structure of a current-interrupting section equipped with a bridging rotary contact shoe.

First, a general configuration of a molded case circuit breaker is schematically shown in FIG. 7. In this figure, reference numeral 1 denotes a main body case of a circuit breaker, 2 is an opening and closing handle, 3 is a toggle type opening and closing (switching) mechanism, and 4 is an over-current tripping device based on a bimetal method or the like. Reference numeral 5 is a current-interrupting section containing fixed contact shoes, a movable (rotary) contact shoe and arc extinguishing devices of a main circuit, and is linked to the opening and closing mechanism 3. An opening and closing operation of such a circuit breaker is well known.

Through an ON/OFF operation of the opening and closing handle 2, the movable contact shoe in the current-interrupting section 5 opens or closes via the opening and closing mechanism 3. Further, when an over-current flows to activate the over-current tripping device 4 while the main circuit is powered, the opening and closing mechanism 3 performs a trip operation to open the movable contact shoe in the current-interrupting section 5, thereby interrupting the over-current from flowing through the main circuit.

Here, an interrupting method used for the current-interrupting section 5 includes a single-break method and a double-break method. An example of a double-break method using a bridging rotary contact shoe as a movable contact shoe has been disclosed in Japanese Patent Publications (KOKAI) No. 06-028964 and No. 06-52777. A configuration of this circuit breaker is shown in FIG. 8. In this figure, reference numeral 6 denotes an insulated case of the current-interrupting section 5; 7A and 7B are power-supply side and load side fixed contact shoes disposed in the insulated case 6 and arranged diagonally opposite to each other; 7*a* is a fixed contact provided at a tip portion of each fixed contact shoe; 8 is a movable contact shoe that bridges the contacts of the fixed contact shoes 7A, 7B; 9 is a rotary drum-shaped contact shoe holder that holds the movable contact shoe 8; and 10 is an arc extinguishing device (grid) positioned at each side of the movable contact shoe 8 and disposed in the insulated case 6.

The movable contact shoe 8 is urged and held in a position by a pressure spring (tension spring or torsion coil spring) 11 loosely fitted and disposed in a through-hole 9*a* formed on the contact shoe holder 9. One end of the fixed contact shoe 7A (a power-supply side) is drawn out from the insulated case 6 to constitute a power-supply-side terminal portion. A terminal portion of the fixed contact shoe 7B (a load side) is connected to the main circuit conductor of the overload tripping device 4, shown in FIG. 4, at a top surface of the insulated case 6.

Further, in the illustrated structure, a tip portion of each of the fixed contact shoes 7A and 7B is folded in a U-shape to form a fixed contact 7*a*. When an over-current such as a short circuit current flows through the main circuit, the movable contact shoe 8 is substantially instantaneously opened before the overload tripping device 4 (see FIG. 7) operates by an electromagnetic resilient force exerted between the tip portions of the fixed contact shoes 7A and 7B and the movable contact shoe 8. Furthermore, the folded portion of each fixed contact shoe has a magnetic yoke 12 to enhance a magnetic field acting on an arc generated between the contacts of the fixed and movable contact shoes during current interruption, thereby increasing the electromagnetic arc driving force to the arc extinguishing devices 10.

It is preferred for the current-interrupting section 5 to be as compact as possible in order to reduce a size of the molded case circuit breaker. However, in the conventional structure of the current-interrupting section shown in FIG. 8, the tip portion of each of the power-supply side and load side fixed contact shoes 7A and 7B is folded in the U-shape to generate the electromagnetic resilient force required to drive and open the movable contact shoe 8 when the over-current flows through the circuit. As a result, the insulated case 6, which contains the fixed contact shoes 7A and 7B, needs to have a larger height H, resulting in a larger size of the current-interrupting section 5.

Further, as shown in FIG. 9, Japanese Patent Publication (KOKAI) No. 01-166429 has disclosed a molded case circuit breaker in which the fixed contact shoes 7A and 7B, disposed in the insulated case 6 of the current-interrupting section 5 and arranged diagonally opposite to each other, are formed of linear contact shoe conductors. The bridging rotary contact shoe 8 is disposed between the fixed contacts 7*a* provided at the tips of the fixed contact shoes 7A and 7B. In this assembly structure, the fixed contact shoes 7A and 7B in the insulated case 6 have a linear shape, thereby allowing the height H of the current-interrupting section 5 to be smaller as compared to the configuration in FIG. 8. On the other hand, a current direction flowing through the fixed contact shoes 7A and 7B is the same as that through the movable contact shoe 8. Therefore, a large electromagnetic resilient force required for driving and opening the movable contact shoe can not be obtained between each of the fixed contact shoes 7A and 7B and the movable contact shoe 8.

It is thus an object of the present invention to provide a molded case circuit breaker having linear shape fixed contact shoes to minimize a current-interrupting section, wherein the contact shoes are arranged so as to generate a large electromagnetic resilient force required for driving and opening a movable contact shoe when an over-current flows through the circuit.

Further objects and advantages will be apparent from the following description of the invention.

SUMMARY OF THE INVENTION

To achieve the objects, the present invention provides a molded case circuit breaker including a current-interrupting section. The current-interrupting section is composed of an insulated case containing arc extinguishing devices; fixed contact shoes on a power-supply side and a load side disposed in the case and arranged diagonally opposite each other; a movable or rotary contact shoe bridging between contacts of the fixed contact shoes; and a rotary contact shoe holder for holding and linking the movable contact shoe and a pressure spring to an opening and closing mechanism of the circuit breaker. The movable contact shoe can be opened by an electromagnetic resilient force exerted when an over-current flows. Contact shoe conductors of the power-supply side and load side fixed contact shoes are substantially linear, and are arranged in parallel and opposite to each other with the movable contact shoe in between. The fixed contact shoes, and the movable contact shoe which is bridging contacts positioned at tips of the fixed contact shoes, are assembled together to form a Z-shape conducting path (the first aspect).

According to this configuration, the fixed contact shoes are composed of linear contact shoe conductors, thereby reducing a height of the current-interrupting section as opposed to the conventional structure having a U-shape fixed contact shoe. Further, when the circuit breaker is powered, a current through the power-supply side and load side fixed contact shoes flows relatively opposite to that through the bridging movable contact shoe. Accordingly, if an over-current flows through the circuit, a large electromagnetic resilient counter force is generated between a tip portion of the power-supply side fixed contact shoe and the movable contact shoe, and between the tip portion of the load side fixed contact shoe and the movable contact shoe. This electromagnetic counter force acts as a driving torque to drive and open the movable contact shoe.

Further, according to the present invention, to further improve the opening operation of the movable contact shoe and the interrupting performance, the following specific approaches are implemented in addition to the above configuration.

A magnetic yoke is disposed in an area around the tip portion of each of the power-supply side and load side fixed contact shoes, thereby enhancing the magnetic field acting on the movable contact shoe to increase the electromagnetic counter force. Further, magnetic field acting on an arc generated between the contacts of the fixed and movable contact shoes during current interruption is enhanced to increase an electromagnetic arc driving force directing to the arc extinguishing devices (the second aspect).

The tip portion of each of the power-supply side and load side fixed contact shoes is tilted relative to the movable contact shoe, so that the electromagnetic resilient or counter force generated between the tip portions and the movable contact shoe acts effectively as a driving torque required to rotate the movable contact shoe around its rotational center (the third aspect).

The tip portion of each of the power-supply side and load side fixed contact shoes is set to be narrower than the conductor thereof, which is located behind the tip portion thereof, thereby concentrating a current to strengthen the magnetic field generated in a peripheral area of the tip portions to increase the electromagnetic resilient force acting on the movable contact shoe. In this case, the conductor portion of the contact shoe, which is wider than the tip portion, absorbs and dissipates heat generated at the contact portion as a result of the current interruption to prevent over-heating of the terminal portion of the fixed contact shoe located at the rear end thereof (the fourth aspect).

A magnetic shielding member is provided at an area near each of the tip portions of the fixed contact shoes facing each other with the movable contact shoe in between. This configuration prevents a magnetic field that is applied to the movable contact shoe to rotate in a closing direction of a rotational path of the movable contact shoe (the fifth aspect).

Each of the fixed contact shoes may have a slit at an area near the tip portion thereof facing each other along a longitudinal direction of the contact shoe conductor thereof, and the slit divides the conductor into two lateral portions. The magnetic field generated in a peripheral area of each conductor is dispersed so as to suppress the electromagnetic resilient force acting toward a closing direction of the movable contact shoe (the sixth aspect).

A hot gas discharge port may be provided on each of power-supply side and load side ends of the insulated case of the current-interrupting section. The discharge port has an opening perpendicular and opposite to the contact shoe conductors of the fixed contact shoes drawn out from the insulated case. Consequently, a hot gas generated in the insulated case of the current-interrupting section by the arc generated when a large current is interrupted is prevented from blowing directly against the conductor of each fixed contact shoe drawn out from the insulated case and its periphery, which results in an inter-pole flashover (the seventh aspect).

The terminal portion of the fixed contact shoe laid along a bottom surface of the insulated case is bent in a U-shape and drawn out from an end surface of the insulated case. The magnetic field generated in a periphery of the terminal portion as a result of a current flowing through the contact shoe conductor is prevented from inhibiting extension of an arc generated between the fixed and movable contacts during current interruption, thereby ensuring higher interrupting performance (the eighth aspect).

DETAILED DESCRIPTION OF PREFERRED EMBODIMENTS

Figure 8:
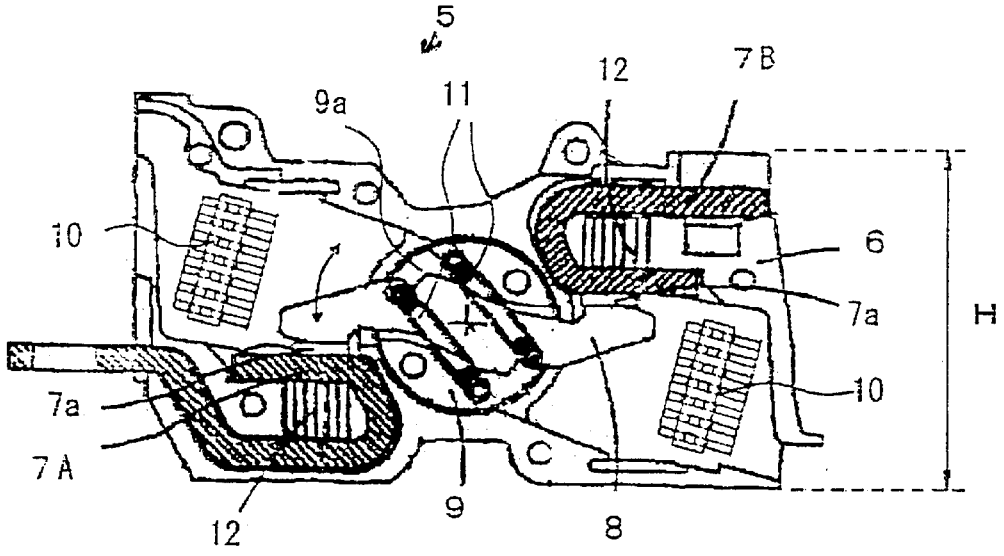
Fig. 8 Prior Art
FIG. 8 is a sectional view showing a configuration of a conventional current-interrupting section.
Figure 9:
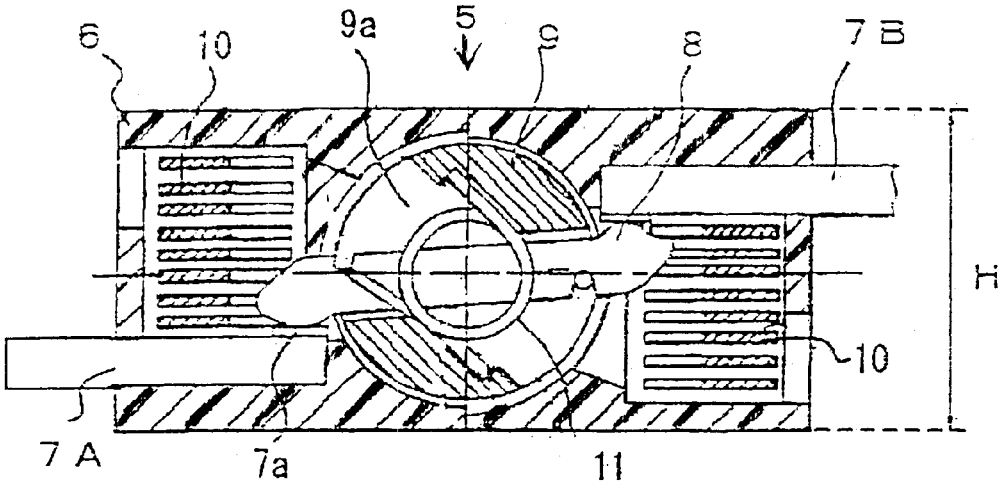
Fig. 9 Prior Art
FIG. 9 is a sectional view showing a configuration of another conventional current-interrupting section.

Hereunder, embodiments of the present invention will be explained with reference to the accompanied drawings. In the figures, the same components as those in FIGS. 8 and 9 are denoted by the same reference numerals, and the description of them is omitted.

Figure 1A:
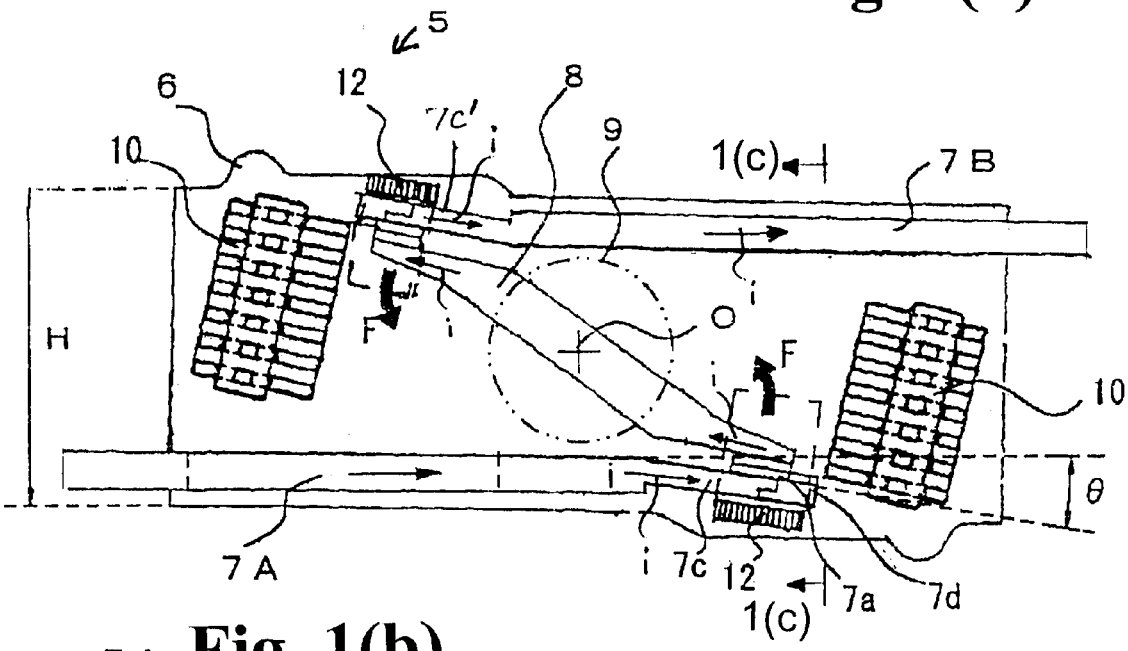
FIG. 1(*a*) is a side view showing a configuration of internal mechanisms of the first embodiment of a current-interrupting section, FIG. 1(*b*) is a plan view of fixed contact shoes in FIG. 1(*a*), and FIG. 1(*c*) is a sectional view taken along line 1(*c*)—1(*c*) in FIG. 1(*a*)
Figure 1B:
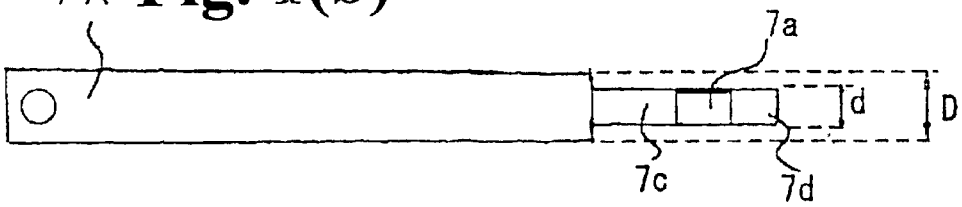
Figure 1C:
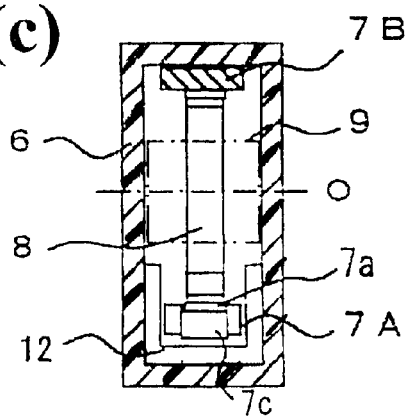

In FIGS. 1(*a*) to 1(*c*), a current-interrupting section 5 of a molded case circuit breaker includes a power-supply side and load side fixed contact shoes 7A, 7B, and is disposed in an insulated case 6. The fixed contact shoes 7A, 7B are composed of substantially linear contact shoe conductors, and arranged in parallel and facing each other with a rotary (movable) contact shoe 8 in between. The power-supply side fixed contact shoe 7A, drawn into a bottom of the insulated case 6 from a left side thereof, has a tip portion 7*c* provided with a fixed contact 7*a*. The tip portion 7*c* extends beyond a rotational center O of the movable contact shoe 8 held in a rotary-drum-shaped contact shoe holder 9, and reaches an arc extinguishing device 10 disposed at a right side of the insulated case 6.

On the other hand, the load side fixed contact shoe 7B, drawn into a top of the insulated case 6 from a right side thereof, has a tip portion 7*c*' extending beyond the rotational center O of the movable contact shoe 8 to the arc extinguishing device 10 disposed at a left side of the insulated case 6. The fixed contact shoes 7A and 7B form a Z-shaped conducting path with the movable contact shoe 8 that is disposed diagonally so as to bridge the fixed contacts 7*a* of the fixed contact shoes 7A and 7B.

The tip portion 7*c* of the fixed contact shoe 7A is provided with the fixed contact 7*a* and tilted away from the movable contact shoe 8 (with a tilt angle θ). A conductor portion of the tip portion 7*c* has a width "d" smaller than a width "D" of a conductor portion of the fixed contact shoe located behind the tip portion 7*c*. Reference numeral 7*d* denotes an arc runner (an arc horn) extending further from the fixed contact 7*a* to the corresponding arc extinguishing device 10. FIG. 1(*b*) is a plan view of the power-supply side fixed contact shoe 7A, but similar arrangements are provided for the load side fixed contact shoe 7B.

Further, a U-shaped magnetic yoke 12 is disposed in the insulated case 6 so as to surround back, right and left sides of the tip portion 7*a* of each of the fixed contact shoes 7A and 7B. The magnetic yoke 12 enhances magnetic field acting on an arc generated between the contacts of the fixed and movable contact shoes during current interruption to increase the arc driving force required to extend the arc to the corresponding arc extinguishing device 10. The magnetic yoke 12 is composed of a stack of thin steel plates in order to reduce eddy current loss.

According to this configuration, the contact shoe conductors of the fixed contact shoes 7A and 7B laid inside the insulated case 6 are linear, thereby reducing a height 'H' of the current-interrupting section 5 as compared to the conventional configuration in FIG. 8 in which each tip portion of the fixed contact shoes 7A and 7B is folded in the U-shape. Further, a main circuit current in the current-interrupting section 5 flows through a Z-shape conducting path, composed of the fixed contact shoes 7A and 7B and the movable contact shoe 8, as shown by arrows 'i' in the figure. In this conducting path, the direction of the current 'i' is reversed at the tip portions of the fixed contact shoes 7A and 7B and the tip portions of the movable contact shoe 8. Thus, the current creates an electromagnetic resilient or counter force 'F' between the fixed contact shoes 7A and 7B and the movable contact shoe 8 on the basis of a principle similar to that of the U-shape fixed contact shoes shown in FIG. 8.

The movable contact shoe 8 is urged and closed by a pressure spring assembled on the contact shoe holder 9 as in the case of the structures shown in FIGS. 8 and 9. Since a regular current and a minor overload current will not generate a large electromagnetic resilient force, the movable contact shoe 8 will not open. In contrast, when an excessive current such as a short circuit current (10 to 20 times larger than the regular current) flows, the electromagnetic resilient force 'F' becomes large enough to overcome the spring force of the pressure spring, thereby driving the movable contact shoe 8 counterclockwise around the rotational center 'O' to open it. Further, the magnetic field generated around the movable contact shoe 8 as a result of the current through the fixed and movable contact shoes is applied to an arc of the interrupted current generated between the fixed and movable contact shoes upon opening of the movable contact shoe 8, thereby driving the arc to the arc extinguishing device 10, where it is extinguished.

The tip portions 7*c*, 7*c*' of the fixed contact shoes 7A and 7B may be tilted away from the movable contact shoe 8 as described previously. Accordingly, the electromagnetic resilient force can be further effectively exerted on the movable contact shoe 8 as an opening driving force. Further, each conductor at the tip portions 7*c*, 7*c*' of the fixed contact shoes 7A and 7B has the small width 'd', and a concentrated current is conducted through the tip portions. Therefore, the magnetic fields generated in the areas around the tip portions and acting on the movable contact shoe 8 are enhanced, thus a larger electromagnetic resilient force acts on the movable contact shoe 8.

Figure 2A:
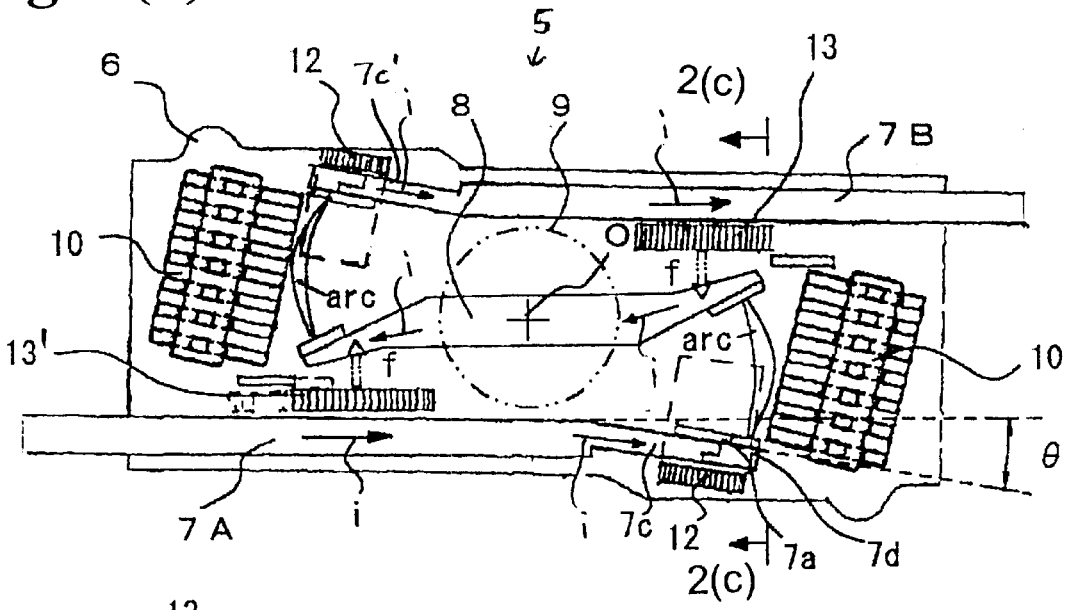
FIG. 2(*a*) is a side view showing a configuration of internal mechanisms of a current-interrupting section of the second embodiment, FIG. 2(*b*) is a plan view of fixed contact shoes in FIG. 2(*a*), and FIG. 2(*c*) is a sectional view taken along line 2(*c*)—2(*c*) in FIG. 2(*a*)
Figure 2B:
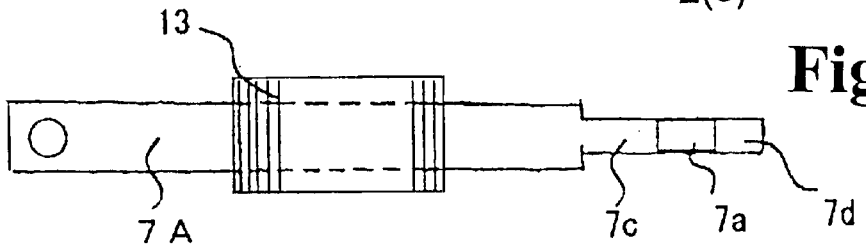
Figure 2C:
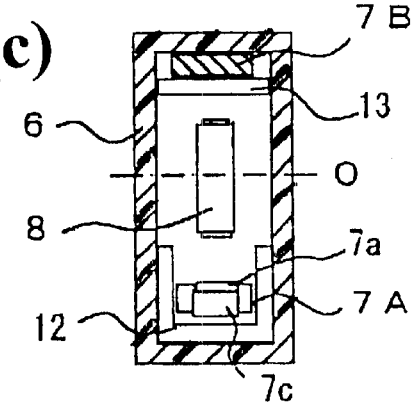

FIGS. 2(*a*) to 2(*c*) shows a configuration of the second embodiment of the present invention. In this embodiment, in addition to the configuration shown in FIGS. 1(*a*)–1(*c*), a magnetic shielding member 13 is installed inside each of the power-supply side and load side fixed contact shoes 7A and 7B to magnetically shield an area between the magnetic shielding member 13 and the movable contact shoe 8. Here, the magnetic shielding member 13 for the power-supply side fixed contact shoe 7A is laid in an area opposite to the tip portion 7*c* of the load side fixed contact shoe 7B with the movable contact shoe 8 in between. The magnetic shielding member 13' for the load side fixed contact shoe 7B is laid in an area opposite to the tip portion 7*c*' of the power-supply side fixed contact shoe 7A. FIG. 2(*b*) is a plan view showing only the power-supply side fixed contact shoe 7A, but similar arrangements are provided for the load side fixed contact shoe 7B as well.

With the configuration described above, as shown in FIG. 2(*a*), while the movable contact shoe 8 is open, even when the contact portions of the movable contact shoe 8 at the opposite ends move closer to middle portions of the conductors of the fixed contact shoes 7A and 7B, which face each other, the movable contact shoe 8 will not be affected by a magnetic effect preventing it from opening. That is, without the magnetic shielding members 13, the conducting current generates electromagnetic resilient forces 'f' between a right end of the movable contact shoe 8 and the contact shoe conductor of the load side fixed contact shoe 7B, and between a left end of the movable contact shoe 8 and the contact shoe conductor of the power-supply side fixed contact shoe 7A. Consequently, the movable contact shoe 8 is hindered from opening. Further, under the magnetic effects, arc generated between the movable and fixed contact shoes is also hindered from being driven to the arc extinguishing devices 10.

By providing the magnetic shielding members 13 as in the embodiment, the magnetic shielding effects reduce the electromagnetic resilient forces 'f', which hinder the movable contact shoe 8 from opening, as well as the electromagnetic forces, which hinder the current arc generated between the contacts from extending. Accordingly, the movable contact shoe 8 opens quickly during an opening operation. Therefore, the electromagnetic resilient force generated by the over-current is applied to the movable contact shoe 8 to open the same without slowing, thereby improving the interrupting performance of the circuit breaker.

Figure 3A:
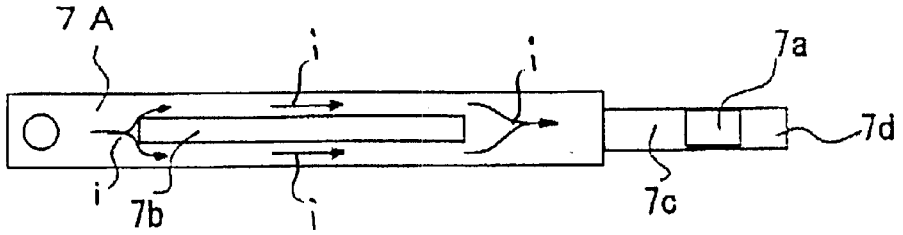
FIG. 3(*a*) is a plan view of fixed contact shoes of the third embodiment of the invention, and FIG. 3(*b*) is a diagram showing a magnetic field distribution.
Figure 3B:
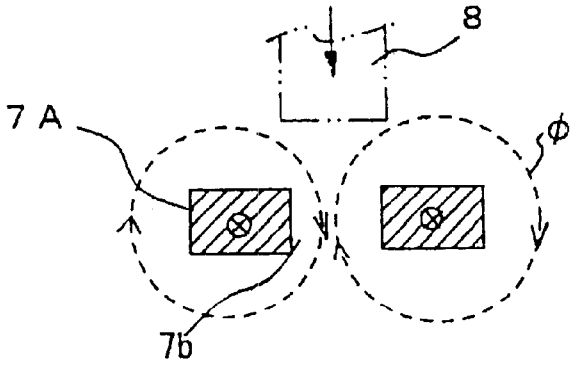

FIGS. 3(*a*) and 3(*b*) show the third embodiment of the present invention. In this embodiment, each of the fixed contact shoes 7A and 7B has a slit 7*b* formed along a longitudinal direction thereof in a middle of the contact shoe conductor (the same area in which the magnetic shielding member 13 is disposed in the example in FIGS. 2(*a*)–2(*c*)), and the slit divides the conducting path into two lateral portions. Thus, as shown in FIG. 3(*b*), the conducting current 'i' disperses a magnetic field generated in an area around the conductor laterally, thereby reducing the electromagnetic resilient force that acts in the direction in which the movable contact shoe 8 is prevented from opening. This produces effects similar to those of the previous embodiment to ensure the high interrupting performance.

Figure 4:
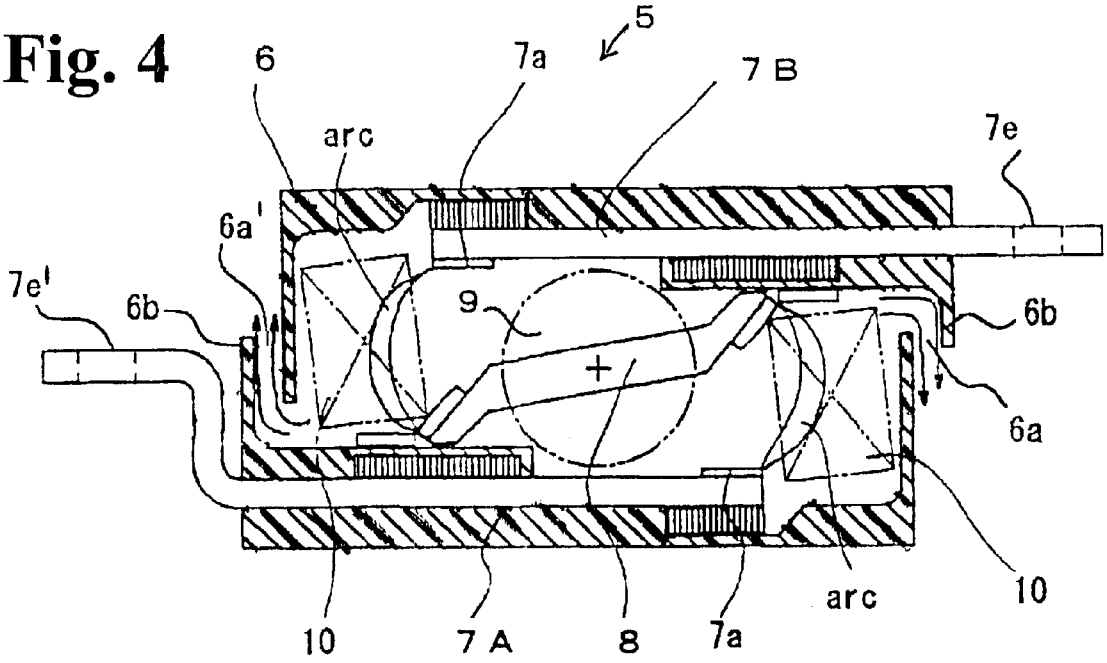
FIG. 4 is a sectional view showing a configuration of a current-interrupting section of the fourth embodiment of the invention.
Figure 5:
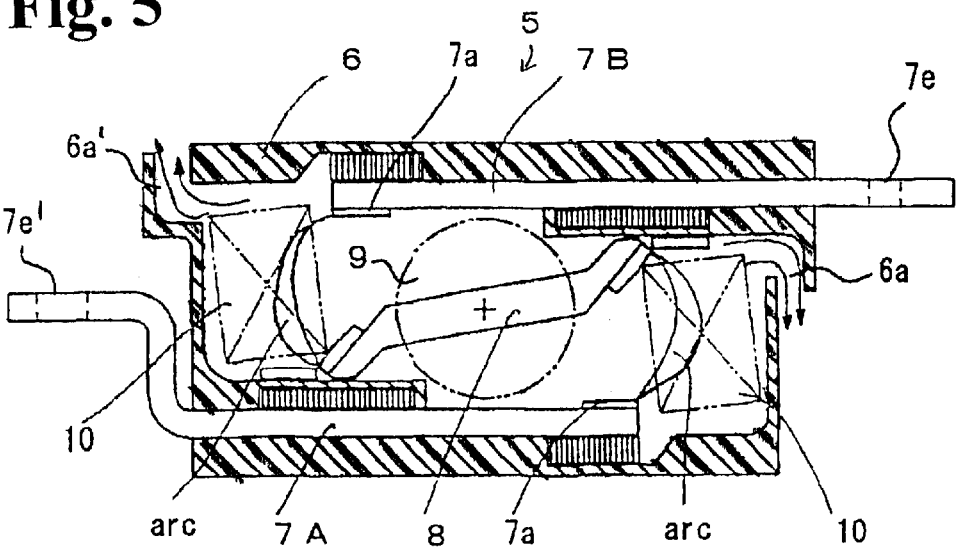
FIG. 5 is a sectional view showing a configuration of the current-interrupting section of the fifth embodiment.

FIGS. 4 and 5 show the fourth and fifth embodiments of the present invention. In these embodiments, a hot gas discharge port 6*a* or 6*a*' (an opening for a hot gas generated in the insulated case due to an arc during current interruption to pass through to the exterior) is provided on each of the power-supply side and load side surfaces of the insulated case 6 (right and left surfaces in the figure).

Figure 7:
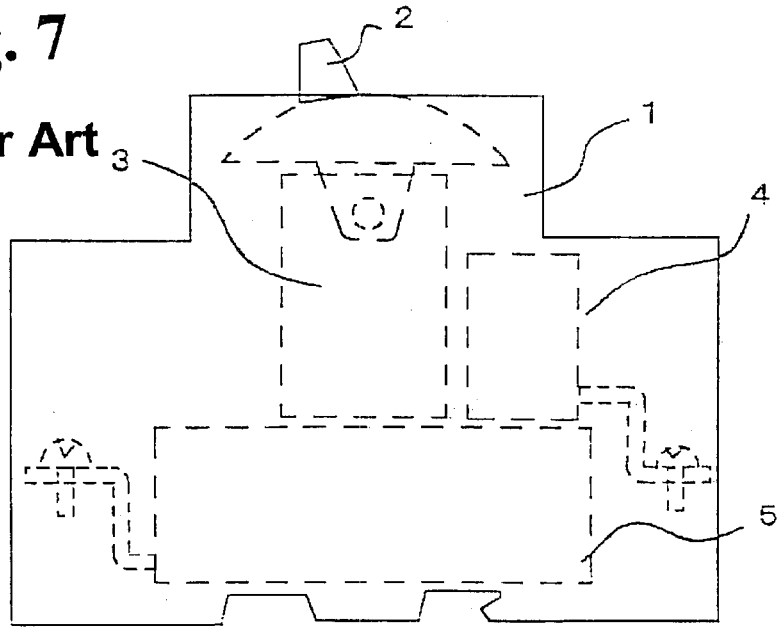
Fig. 7 Prior Art
FIG. 7 is a schematic diagram showing a general configuration of a molded case circuit breaker.

The hot gas discharge port 6*a* is provided on a vertical gas deflecting wall 6*b* formed along the side surface of the insulated case 6. Each hot gas discharge port extends perpendicular to and away from each contact shoe conductor of the fixed contact shoes 7A and 7B laid on the top and bottom surfaces of the insulated case 6 and drawn out from the case end surface. Reference numerals 7*e*, 7*e*' denote the terminal portions of the fixed contact shoes 7A and 7B. The terminal portion 7*e*' of the power-supply side fixed contact shoe 7A is bent in an L-shape and drawn out to the terminal portion of the circuit breaker main body case 1 shown in FIG. 7. In contrast, the terminal portion 7*e* of the load side fixed contact shoe 7B is linear and drawn out and connected to the over-current-tripping device 4 shown in FIG. 7.

Further, in the embodiment in FIG. 4, the hot gas discharge port 6*a*' is provided on the open side of the movable contact shoe 8, whereas in the example in FIG. 5, the power-supply side hot gas discharge port 6*a*' is opened on the closed side of the movable contact shoe 8 so as to be located away from the terminal portion 7*e*' of the fixed contact shoe 7A.

With this configuration, the hot gas (containing conductive components such as metallic vapors or ion from the contact members generated by an arc) generated inside the insulated case 6 by an arc during the current interruption blows out from the arc extinguishing device 10 and then changes its direction to a vertical one as represented by the arrow in the figure. The gas is then emitted in a direction opposite to each of the fixed contact shoes 7A and 7B through each of the hot gas discharge ports 6*a*, 6*a*'. This prevents the hot gas from blowing directly toward the contact shoe conductors of the fixed contact shoes 7A and 7B drawn out from the insulated case 6, thereby maintaining insulation of the terminal portions 7*e* and their peripheries without being affected by the hot gas.

In the conventional structure in which the hot gas discharge port is simply opened in each end surface of the insulated case, the hot gas may blow toward the terminal portions of the fixed contact shoes and their peripheries to cause an inter-pole flashover.

Figure 6:
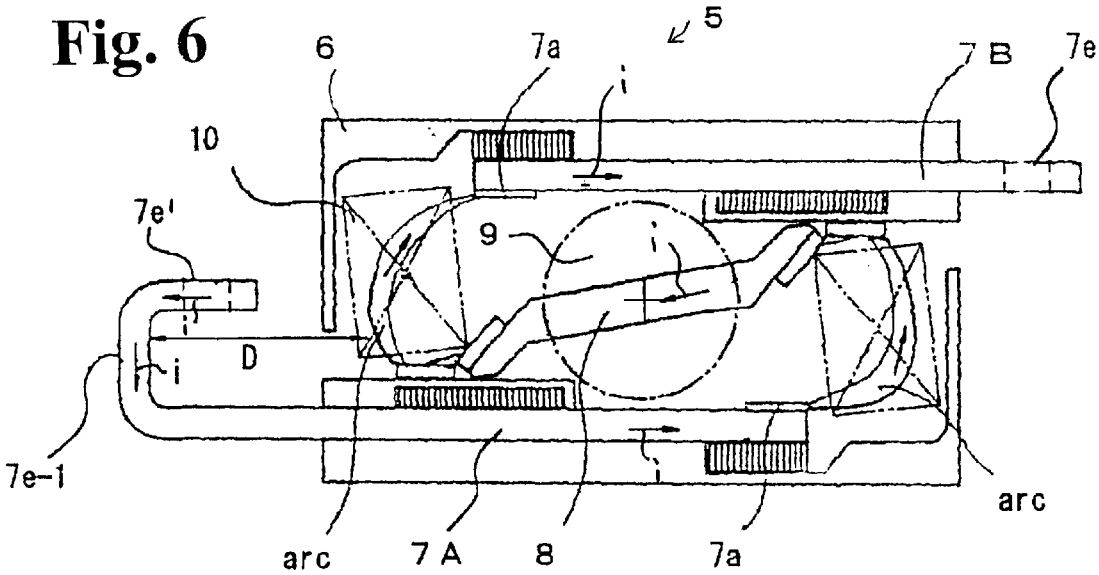
FIG. 6 is a sectional view showing a configuration of a current-interrupting section of the sixth embodiment of the invention.

FIG. 6 shows the sixth embodiment of the present invention. In this embodiment, the power-supply side fixed contact shoe 7A, which is laid on the bottom of the insulated case 6 and drawn out from the insulated case 6, is bent in a U-shape to form a terminal portion 7*e*' as shown in the figure, and the U-shape folded portion 7*e*-1 extends upward outside the terminal portion 7*e*.

In the conventional circuit breaker shown in FIG. 8 or previous embodiments (see FIGS. 4 and 5), the terminal 7*e*' of the fixed contact shoe 7A drawn out from end surface of the insulated case 6 is folded in the L-shape so as to extend along the case end surface.

Here, the electromagnetic force acts between the magnetic field generated around the contact shoe conductor 7A by a current flowing therethrough, and the arc generated between the fixed and movable contact shoes upon the current interruption. In the conventional structure, the arc extending to the arc extinguishing device 10 becomes close to the contact shoe conductor, which extends along the end surface of the insulated case 6. Thus, the arc is significantly affected by the magnetic field. Moreover, the current in the rising portion (the vertical portion) of the contact shoe conductor flows in a direction opposite to that of the arc current. According to Fleming left hand rule, the magnetic field inhibits the arc from extending and pushes it back toward the contact.

In the structure in FIG. 6, the contact shoe conductor of the fixed contact shoe 7A is drawn out from the insulated case 6, and bent in the U-shape to form the terminal portion 7*e*'. Thus, a distance 'D' between the vertical portion of the U-shape folded terminal portion 7*e*-1, through which the current flows in the direction opposite to that of the arc current, and the arc extending between the contacts is larger than that in the conventional structure. This reduces the effect on the arc by the magnetic field generated around the contact shoe conductor of the U-shape folded portion 7*e*-1 by the current flowing through it (the intensity of the magnetic field acting on the arc is inversely proportional to the distance 'D' from the contact shoe conductor). Therefore, the electromagnetic force inhibiting the arc from extending is reduced to ensure the high interruption performance.

The structures of the embodiments described previously are individually effective, but the performance of the molded case circuit breaker can further be improved by combining these structures together. The resulting enhancement in the electromagnetic resilient force and arc driving force of the movable contact shoe has been confirmed through magnetic field analyses and experiments conducted by the inventors.

As described above, according to the present invention, the current-interrupting section of the molded case circuit breaker is composed of a combination of the power-supply side and load side fixed contact shoes, and the bridging rotary contact shoe. The contact shoe conductors of the power-supply side and load side fixed contact shoes are substantially linear and are arranged in parallel to face each other with the movable contact shoe in between. Further, the power-supply side and load side fixed contact shoes and the movable contact shoe with the bridging stator contacts positioned at tip portions of the conductors of the fixed contact shoes, are constructed to form the Z-shape conducting path. Consequently, the current-interrupting section is smaller than that of the conventional structure in which the U-shape fixed contact shoes are employed.

Further, in a powered state, the direction of the current flowing through the power-supply side and load side fixed contact shoes is relatively opposite to that of the current flowing through the bridging movable contact shoe. Accordingly, if the over-current flows through the circuit, the large electromagnetic resilient force acting as counter forces in opposite directions is generated between the tip portion of the power-supply side fixed contact shoe and the movable contact shoe, and between the load side fixed contact shoe and the movable contact shoe. This electromagnetic resilient force can be used as driving torque to drive and open the movable contact shoe at a high speed as in the case with the conventional structure employing the U-shape fixed contact shoes.

Furthermore, in addition to the above structure as a basis, the configurations in the other embodiments of the present invention can further improve the interruption performance.

While the invention has been explained with reference to the specific embodiments of the invention, the explanation is illustrative and the invention is limited only by the appended claims.

What is claimed is:

1. A molded case circuit breaker, comprising:

a switching mechanism, and a current-interrupting section connected to the switching mechanism, and including an insulated case; a pair of fixed contact shoes disposed inside the insulated case to face each other, each of said fixed contact shoes having a substantially linear conductor portion, a tip portion and a terminal portion; a rotary contact shoe disposed between the fixed contact shoes so that said fixed contact shoes and said rotary contact shoe form a Z-shape conducting path when the switching mechanism is on, and the rotary contact shoe is rotated to be separated from the fixed contact shoe by an electromagnetic counter force when an overcurrent flow through the z-shape conducting path; and a contact shoe holder linked to the switching mechanism and holding the rotary contact shoe.

2. A circuit breaker according to claim 1, further comprising arc extinguishing devices disposed in the insulated case adjacent the tip portions.

3. A circuit breaker according to claim 1, further comprising magnetic yokes disposed adjacent the tip portions of the fixed contact shoes for enhancing a magnetic field thereof.

4. A circuit breaker according to claim 1, wherein said tip portions of the fixed contact shoes are tilted in directions away from the movable contact shoe.

5. A circuit breaker according to claim 1, wherein each of said tip portions of the fixed contact shoes is narrower than the conductor portion thereof.

6. A circuit breaker according to claim 1, further comprising a magnetic shielding member provided adjacent each of the conductor portions of the fixed contact shoes for shielding a magnetic field thereof.

7. A circuit breaker according to claim 1, wherein each of said conductor portions of the fixed contact shoes has a slit formed along a longitudinal direction thereof for dividing a part of the conducting path into two lateral portions.

8. A circuit breaker according to claim 1, further comprising hot gas discharge ports disposed on end surfaces of the insulated case at power-supply side and load-side, each of said hot gas discharge port extending perpendicular to and away from the contact shoe conductor corresponding thereto for discharging a gas from the insulated case.

9. A circuit breaker according to claim 1, wherein one of the fixed contact shoe is located along a bottom side of the insulated case and has the terminal portion bent in a U-shape extending out from the insulated case.

* * * * *